US011380267B2

(12) United States Patent
Woo et al.

(10) Patent No.: US 11,380,267 B2
(45) Date of Patent: Jul. 5, 2022

(54) DISPLAY DEVICE AND DRIVING METHOD THEREOF

(71) Applicant: LG Display Co., Ltd., Seoul (KR)

(72) Inventors: Chang Seung Woo, Paju-si (KR); Seung Wan Cho, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/125,188

(22) Filed: Dec. 17, 2020

(65) Prior Publication Data

US 2021/0201831 A1 Jul. 1, 2021

(30) Foreign Application Priority Data

Dec. 31, 2019 (KR) ..... 10-2019-0179715

(51) Int. Cl.
*G09G 3/3291* (2016.01)

(52) U.S. Cl.
CPC ... *G09G 3/3291* (2013.01); *G09G 2310/0294* (2013.01)

(58) Field of Classification Search
CPC ..... G09G 3/3291; G09G 2310/0294
See application file for complete search history.

(56) References Cited

U.S. PATENT DOCUMENTS

2012/0026144 A1 2/2012 Kang et al.
2018/0218684 A1* 8/2018 Choi ..... G09G 3/3233
2020/0027939 A1* 1/2020 Cho ..... G09G 3/3275

FOREIGN PATENT DOCUMENTS

KR 10-2012-0010824 A 2/2012
KR 10-2019-0079856 A 7/2019

* cited by examiner

*Primary Examiner* — Kenneth B Lee, Jr.
(74) *Attorney, Agent, or Firm* — Morgan, Lewis & Bockius LLP

(57) ABSTRACT

Disclosed are a display device and a driving method thereof. A pixel circuit of the display device may be driven in a data sampling phase and a light emitting phase. A electric current flows in a first effective channel of a driving element in the data sampling phase and a electric current flows in a second effective channel of the driving element in the light-emitting phase.

15 Claims, 22 Drawing Sheets

DISPLAY DEVICE AND DRIVING METHOD THEREOF

CROSS-REFERENCE TO RELATED APPLICATION

This application claims priority to and the benefit of Korean Patent Application No. 10-2019-0179715, filed Dec. 31, 2019, the disclosure of which is incorporated herein by reference in its entirety.

BACKGROUND

1. Technical Field

The present disclosure relates to a display device having a driving element for driving a light emitting element and a driving method thereof.

2. Discussion of Related Art

An electroluminescent display device is roughly classified into an inorganic light emitting display device and an organic light emitting display device according to the material of a light emitting layer. The organic light emitting display device having an active matrix type includes an Organic Light Emitting Diode (hereinafter referred to as "OLED") that emits light by itself. Accordingly, there are advantages that the response speed is fast, and the luminous efficiency, brightness and viewing angle are large. The OLED is formed on each of the pixels. Thus, the organic light emitting display device has a high response speed, excellent luminous efficiency, brightness, viewing angle, and the like, and is capable of expressing black gradation in complete black, thereby providing excellent contrast ratio and color reproduction.

The organic light emitting display device does not require a backlight unit and can be implemented on a flexible plastic substrate, a thin glass substrate, and a metal substrate. Therefore, a flexible display can be implemented as an organic light emitting display device.

The pixels of the organic light emitting display device include an OLED, a driving element that drives the OLED by adjusting an electric current flowing through the OLED according to the gate-source voltage Vgs, and a storage capacitor that maintains a gate voltage of the driving element.

The driving element may be implemented as a transistor. In order to make the image quality of the entire screen of the organic light emitting display device uniform, it is preferable that the driving element has uniform electrical characteristics among all pixels. However, there may be a difference in the electrical characteristics of the driving element between the pixels due to process deviations and device characteristic deviations caused in the manufacturing process of the display panel. This difference may become larger as the driving time of the pixels elapses. In order to compensate for deviations in the electrical characteristics of the driving element between pixels, an internal compensation technology or an external compensation technology may be applied to the organic light emitting display device.

The internal compensation technology may sense a threshold voltage of the driving element for each sub-pixel by using an internal compensation circuit embedded in each pixel to compensate a data voltage by the threshold voltage. The external compensation technology may sense in real time electric current or voltage of the driving elements that changes according to the electrical characteristic of the driving elements by using an external compensation circuit. The external compensation technology may compensate in real time the electrical characteristic deviations (or variations) of the driving elements by modulating a pixel data (digital data) of the input image by the deviations (or variations) of the electrical characteristic of the driving elements sensed for each pixel.

SUMMARY

It is difficult for driving elements to be manufactured exactly the same in all pixels due to a process spread. If there are deviations in the driving elements, an electric current flowing through the OLED may fluctuate between pixels. In this case, a luminance difference may be seen between pixels at the same gradation. In order to reduce the electric current fluctuations in the OLED due to the process spread of the driving elements, a length of a channel of the driving elements may be increased. However, as can be seen in the equation below, when the length of the channel of the driving elements is increased, the electric current $I_{OLED}$ of the OLED may be decreased, such that the charge amount of the anode of the OLED may be decreased as follows:

$$I_{OLED} = \frac{1}{2}\mu C_{OX}\frac{W}{L}(V_{gs} - V_{th})^2$$

where μ represents mobility, Cox represents an oxide capacity, Vgs represents a gate-source voltage, and Vth represents a threshold voltage. In addition, W is a width of the channel, and L is a length of the channel.

Accordingly, embodiments of the present disclosure are directed to a display device and driving method thereof that substantially obviate one or more of the problems due to limitations and disadvantages of the related art.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

The present disclosure provides a display device and a driving method thereof for increasing the channel length of a driving element but reducing a length of an effective channel in which electric current flow.

The problems of the present disclosure are not limited to the problems mentioned above, and other problems not mentioned will be clearly understood by those skilled in the art from the following descriptions.

A display device of the present disclosure may include a pixel circuit including a driving element for driving a light emitting element.

The driving element may include an active pattern ACT having first and second effective channels CH1 and CH2 having different path lengths. In a data sampling phase, a data voltage may be applied to a gate of the driving element and an electric current flow in the first effective channel CH1. In a light emitting phase, the electric current flows in the second effective channel CH2. The length of the second effective channel CH2 is shorter than the length of the first effective channel CH1.

The driving method of the display device may include applying a data voltage to a gate of the driving element in the data sampling phase, and supplying an electric current to the light emitting element in the light emitting period.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain various principles. In the drawings.

DETAILED DESCRIPTION

Figure 1:
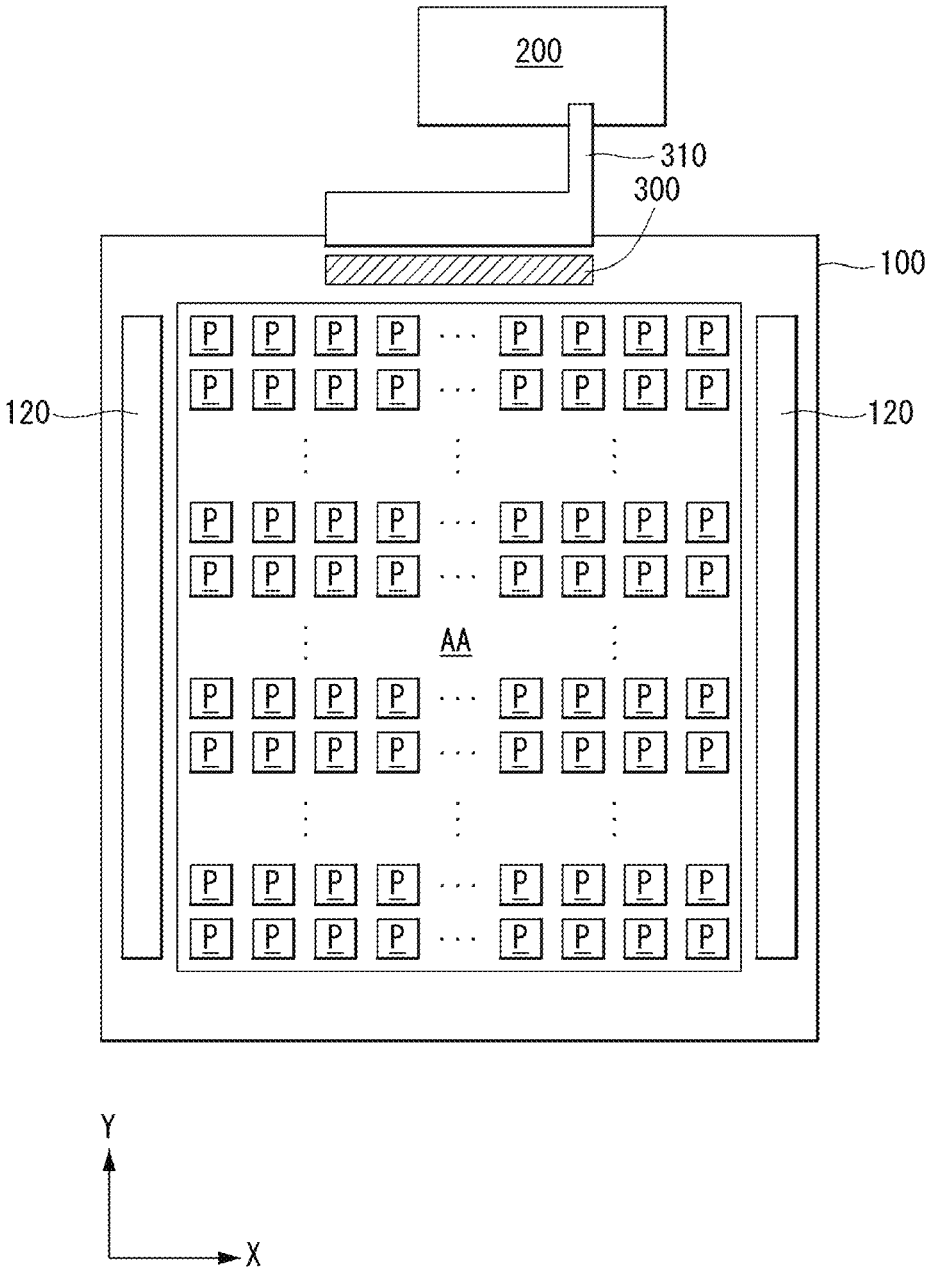
FIG. 1 is a block diagram showing a display device according to an exemplary embodiment of the present disclosure.

Advantages and features of the present disclosure, and implementation methods thereof will be clarified by the following embodiments described with reference to the accompanying drawings. However, the present disclosure is not limited to embodiments disclosed below, but will be implemented in various different forms. Only the embodiments are provided to make the disclosure of the present disclosure complete and to fully convey the scope of the present disclosure to those skilled in the art. It is to be noted that the scope of the present disclosure is only defined by the claims.

The shapes, sizes, ratios, angles, numbers, etc. disclosed in the drawings for describing the embodiments of the present disclosure are merely illustrative and are not limited to the illustrated matters in the present disclosure. The same reference numerals throughout the specification refer to the same components.

The description of the present disclosure, when it is determined that detailed descriptions of related known technologies may unnecessarily obscure the subject matter of the present disclosure, detailed descriptions thereof will be omitted. Terms such as "including", "having" and "comprising" used herein are intended to allow other elements to be added unless the terms are used with the term "only." Any references to singular may include plural unless expressly stated otherwise Components are interpreted to include an ordinary error range even if not expressly stated.

For description of positional relationships, for example, when the positional relationship between two parts is described as "on," "above," "below," "next to," and the like, one or more parts may be interposed therebetween unless the term "immediately" or "directly" is used in the expression.

In the description of the embodiments, the first, second, etc. are used to describe various components, but these components are not limited by these terms. These terms are only used to distinguish one component from another component. Therefore, a first component mentioned below may be a second component within the technical spirit of the present disclosure.

The same reference numerals refer to the same components throughout the specification.

The features of various embodiments of the present disclosure may be partially or entirely bonded to or combined with each other. The embodiments may be interoperated and performed in various ways technically and may be carried out independently of or in association with each other.

In the display device of the present disclosure, the pixel circuit and the gate driving unit may include a plurality of transistors. The transistors may be implemented as an oxide TFT (Thin Film Transistor) including an oxide semiconductor, an LTPS TFT including a Low Temperature Poly Silicon (LTPS) and the like. Each of the transistors may be implemented as a p-channel MOSFET (Metal-Oxide-Semiconductor Field Effect Transistor) or a transistor having an re-channel MOSFET structure. In the embodiment, the transistors of the pixel circuit are mainly described as an example implemented with a p-channel transistor, but the present disclosure is not limited thereto.

The transistors are three-electrode elements including a gate, a source, and a drain. The source is an electrode that supplies carriers to the transistor. In the transistor, the carriers begin to flow from the source. The drain is an electrode from which carriers are moved out of the transistor. In the transistor, the carriers move from the source to the drain. In the case of an n-type transistor, the carriers are electrons. Thus, the source voltage is lower than the drain voltage so that the electrons move from the source to the drain. In the n-type transistor, the direction of an electric current is from the drain to the source. In the case of a p-type transistor, the carriers are holes. Thus, the source voltage is higher than the drain voltage so that the holes may move from the source to the drain. In the p-type transistor, the direction of an electric current is from the source to the drain because the holes move from the source to the drain. It should be noted that the source and drain of the transistor are not fixed. For example, the source and drain of the transistor may be changed depending on an applied voltage. Therefore, the present disclosure is not limited due to the source and drain of the transistor. In the following description, the source and drain of the transistor will be referred to as first and second electrodes.

The gate signal swings between a gate-on voltage and a gate-off voltage. The gate-on voltage is set to a voltage higher than a threshold voltage of the transistor, and the gate-off voltage is set to a voltage lower than the threshold voltage of the transistor. The transistor is turned on in response to the gate-on voltage, while it is turned off in response to the gate-off voltage. In the case of an n-channel transistor, the gate-on voltage may be a Gate High Voltage (VGH), and the gate-off voltage may be a Gate Low Voltage (VGL). In the case of a p-channel transistor, the gate-on voltage may be the Gate Low Voltage (VGL) and the gate-off voltage may be the Gate High Voltage (VGH).

In the following embodiments, the pixel circuit is mainly described as an example implemented with p-channel transistors, but the present disclosure is not limited thereto. In an embodiment, "VGL" represents the gate-on voltage of the scan signal, "VGH" represents the gate-off voltage of the scan signal, "VEL" represents the gate-on voltage of an emission control signal (hereinafter referred to as "EM signal"), and "VEH" represents the gate-off voltage of the EM signal.

Figure 6:
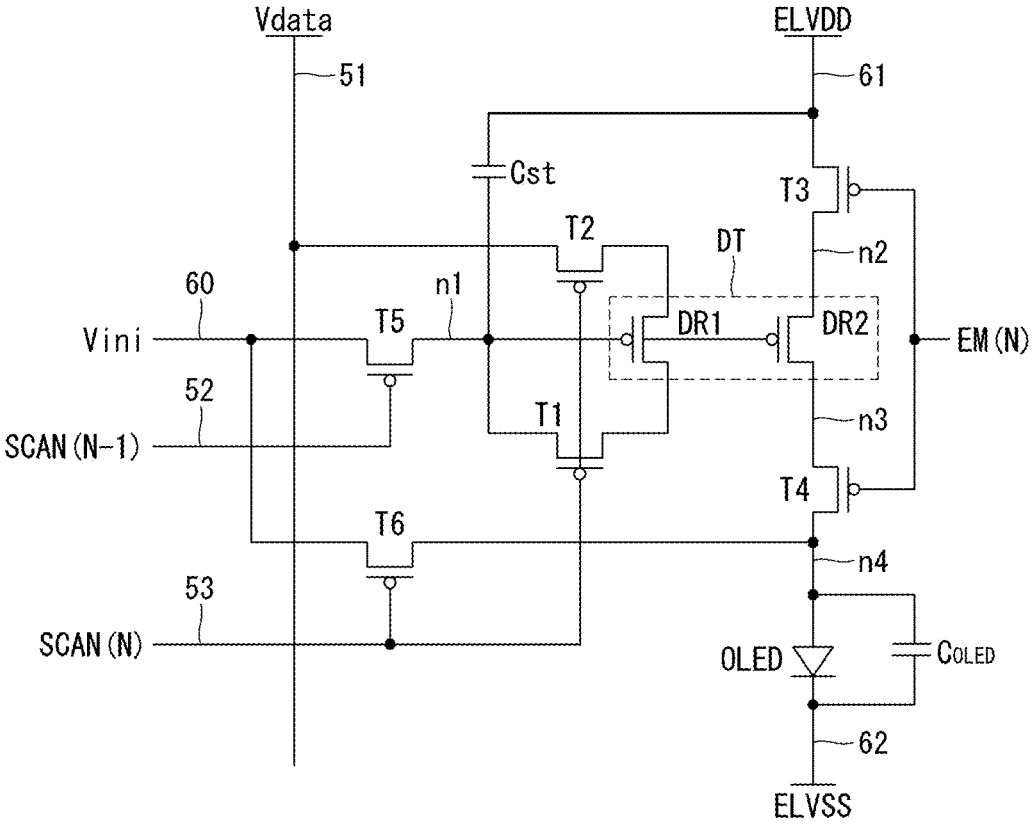
FIG. 6 is a circuit diagram showing a pixel circuit including an internal compensation circuit.

Each of the pixels of the present disclosure includes a light emitting element, a driving element for adjusting an electric current flowing through the light emitting element according to the gate-to-source voltage, and an internal compensation circuit for sensing a threshold voltage of the driving element and supplying it a capacitor in a data sampling phase defined by a pulse of the scan signal. The internal compensation circuit includes a capacitor connected to a gate of the driving element and one or more switch elements connecting the capacitor to the driving element and the light emitting element, as shown in FIG. 6.

Hereinafter, the various embodiments of the present disclosure will be described in detail with reference to the accompanying drawings.

Referring to FIGS. 1 to 4, the display device of the present disclosure includes a display panel 100 and display panel driving units 120 and 300.

The display panel driving units 120 and 300 display an image on the screen by writing pixel data of an input image to pixels on the screen. The display panel driving units 120 and 300 include a gate driving unit 120 for supplying gate signals to gate lines GL1 to GL2 of the display panel 100, a data driving unit 306 for converting the pixel data to a voltage of a data signal (hereinafter referred to as "data voltage") and for supplying it to data lines through data output channels, and a timing controller 303 for controlling the operation timing of the data driving unit 306 and the gate driving unit 120. The data driving unit 306 and the timing controller 303 may be integrated in a drive IC (Integrated Circuit) 300.

The screen of the display panel 100 includes data lines DL1 to DL6, gate lines GL1 and GL2 intersecting with the data lines DL1 to DL6, and a pixel array AA in which pixels P are arranged in a matrix form. The pixels P are arranged in the pixel array AA in a matrix form defined by the data lines DL1 to DL6 and the gate lines GL1 and GL2. The pixels P may be applied with a pixel data voltage to display an image.

Each of the pixels P includes sub-pixels having different colors for color realization. The sub-pixels include red (hereinafter referred to as "R sub-pixel"), green (hereinafter referred to as "G sub-pixel"), and blue (hereinafter referred to as "B sub-pixel"). Although not illustrated, the sub-pixels may further include a white sub-pixel. Hereinafter, the pixel may be interpreted as a sub-pixel.

Each of the sub-pixels may include an internal compensation circuit that compensates for the gate voltage of the driving element by sensing an electrical characteristic of the driving element, for example, a threshold voltage.

Figure 2:
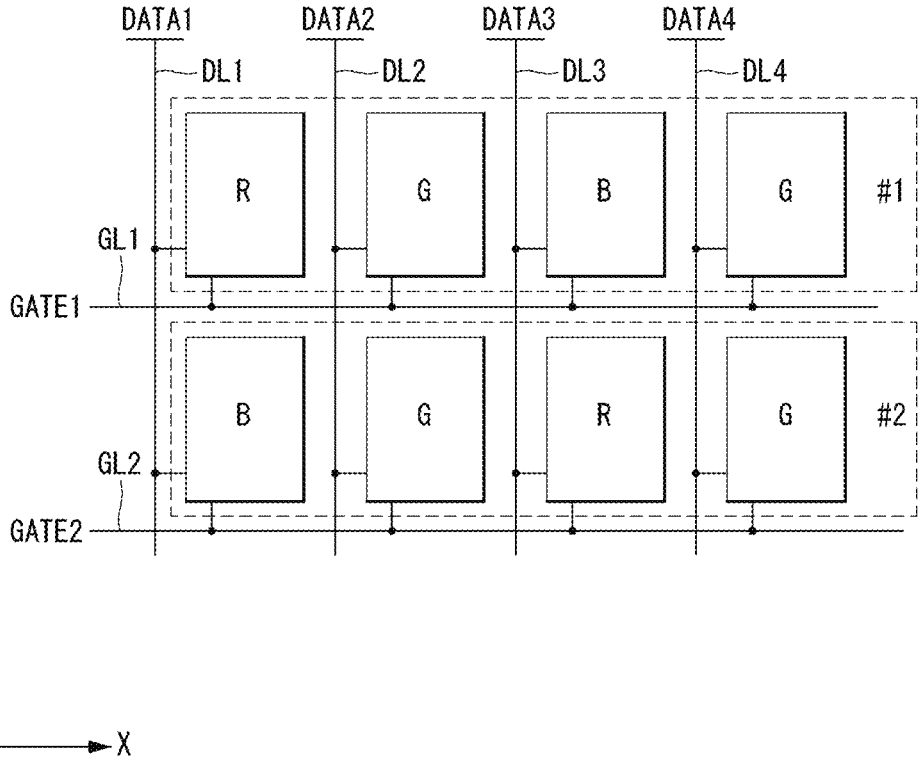
FIG. 2 is a view showing an example of a pentile pixel arrangement.

The pixels P may be arranged as a real color pixel and a pentile pixel. By utilizing a predetermined pentile pixel rendering algorithm, two sub-pixels having different colors may be driven as a one-pixel P in the pentile pixel, such that a resolution higher that of the real color pixel may be implemented, as illustrated in FIG. 2. The pentile pixel rendering algorithm compensates for the color expression that is insufficient in each of the pixels P with the color of light emitted from adjacent pixels.

Figure 3:
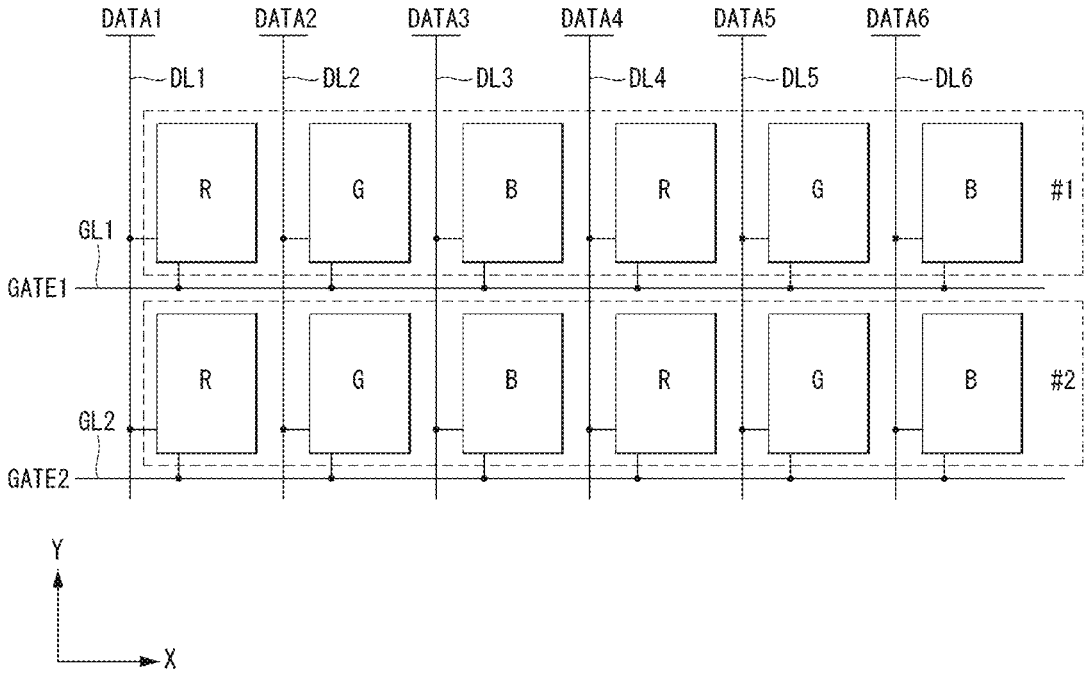
FIG. 3 is a view showing an example of real pixel arrangement.

In the case of the real color pixel, a one-pixel P is composed of R, G and B sub-pixels, as shown in FIG. 3.

When the resolution of the pixel array AA is n*m, the pixel array AA includes n pixel columns and m pixel lines intersecting with the pixel column. In FIGS. 2 and 3, #1 and #2 denote numbers of pixel lines. The pixel column includes pixels arranged along the Y-axis direction. The pixel line includes pixels arranged along the X-axis direction. One horizontal period 1H is a period obtained by dividing one frame period by the number of m pixel lines. The gate driving unit 120 may sequentially output the gate signal from the first pixel line to the m pixel line to progressively scan pixels in line units. The pixels of one-pixel line may operate as initialization, sensing, and data writing within one horizontal period 1H.

The pixel array AA of the display panel 100 may be formed on a glass substrate, a metal substrate, or a plastic substrate. In the case of a plastic OLED panel, the pixel array AA may be formed on the plastic substrate to be implemented as a flexible panel. The plastic OLED panel may include the pixel array AA on an organic thin film adhered to a back plate. A touch sensor array may be formed on the pixel array AA.

The back plate may be a PET (Polyethylene Terephthalate) substrate. The organic thin film is formed on the back plate. The pixel array AA and a touch sensor array may be formed on the organic thin film. The back plate blocks the moisture permeation toward the organic thin film so that the pixel array AA is not exposed to humidity. The organic thin film may be a thin polyimide (PI) film substrate. A multilayer buffer film may be formed of an insulating material (not shown) on the organic thin film. The wirings for supplying power or signals applied to the pixel array AA and the touch sensor array may be formed on the organic thin film.

The gate driving unit 120 may be mounted on the substrate of the display panel 100 together with the pixel array AA. The gate driving unit 120 directly formed on the substrate of the display panel 100 is known as a Gate in panel (GIP) circuit.

The gate driving unit 120 may be disposed on one of the left and right bezels of the display panel 100 to supply the gate signal to the gate lines GL1 and GL2 in a single feeding manner. In the case of the single feeding manner, one of the two gate driving units 120 in FIG. 1 is not required.

The gate driving unit 120 may be disposed on each of the left and right bezels of the display panel 100 to supply the gate signal to the gate lines GL1 and GL2 in a double feeding manner. In the double feeding manner, the gate signal may be simultaneously applied from opposite ends of one gate line.

The gate driving unit 120 may be driven according to the gate timing signal supplied from the drive IC 300 using a shift register to supply gate signals GATE1 and GATE2 to the gate lines GL1 and GL2. The shift register may sequentially supply the gate signals GATE1 and GATE2 to the gate lines GL1 and GL2 by shifting the gate signals GATE1 and GATE2. The gate signals GATE1 and GATE2 may include scan signals SCAN(N−1) and SCAN(N), EM signals EM(N), and the like shown in FIGS. 6 and 7. The scan signals SCAN(N−1) and SCAN(N) are synchronized with the data voltages DATA1 to DATA6 of the pixel data.

The drive IC 300 may output a gate timing signal for controlling the gate driving unit 120 through the gate timing signal output channels. The gate timing signal may include a start signal and a shift clock input to the shift register. The drive IC 300 may be connected to the data lines DL1 to DL6 through the data channels to supply the data voltages DATA1 to DATA6 to the data lines DL1 to DL6.

Figure 4:
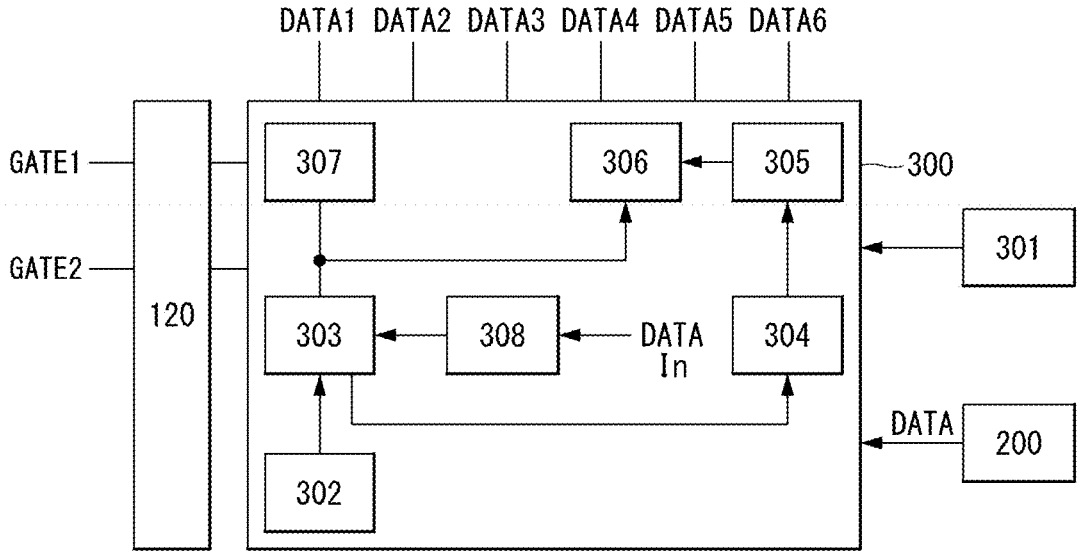
FIG. 4 is a block diagram showing a drive IC configuration shown in FIG. 1.

The drive IC 300 may be connected to a host system 200, a first memory 301, and the display panel 100 as shown in FIG. 4. The drive IC 300 may include a data operation unit 308, a timing controller 303, and a data driving unit 306. The drive IC 300 may further include a second memory 302, a gamma compensation voltage generator 305, a power supply unit 304, a level shifter 307, and the like.

The timing controller 303 may provide the pixel data PDATA of the input image received from the host system 200 to the data driving unit 306. The timing controller 303 may generate a gate timing signal for controlling the gate driving unit 120 and a source timing signal for controlling the data driving unit 306 to control the operating timing of the gate driving unit 120 and the data driving unit 306.

The drive IC 300 may generate gate timing signals for driving the gate driving unit 120 through the timing controller 303 and the level shifter 307. The gate timing signal includes a gate timing signal such as a start pulse VST, a shift clock GCLK, etc., and a gate voltage such as a gate on voltage, a gate off voltage, etc. The start pulse VST and the shift clock GCLK swing between the gate-on voltage and the gate-off voltage.

The data operation unit 308 may include a receiving section that receives pixel data input as a digital signal from the host system 200, and a data operation section that modulates the pixel data input through the receiving unit with a predetermined image quality algorithm to improve image quality. The data operation unit 308 may include a data restoration section for decoding and restoring a compressed pixel data, an optical compensation section for adding a predetermined optical compensation value to the pixel data, a luminance adjustment section for controlling luminance and power consumption by calculating the average image level (APL) of the input image, etc. The optical compensation value may be set as a value for correcting the luminance of each pixel data based on the luminance of the screen measured based on a camera image captured in the manufacturing process.

The data driving unit 306 converts the pixel data (digital signal) received from the timing controller 303 to a gamma compensation voltage using a digital to analog converter (hereinafter referred to as "DAC") to output the data voltages DATA1 to DATA6. The data voltages DATA1 to DATA6 output from the data driving unit 306 are supplied to the data lines DL1 to DL6 of the pixel array AA through an output buffer connected to the data channel of the drive IC 300.

The gamma compensation voltage generator 305 distributes a gamma reference voltage from the power supply unit 304 through a voltage dividing circuit to generate gamma compensation voltage for each gradation. The gamma compensation voltage is an analog voltage whose voltage is set for each gradation of the pixel data. The gamma compensation voltage output from the gamma compensation voltage generator 305 is provided to the data driving unit 306.

The level shifter 307 converts a low level voltage of the gate timing signal received from the timing controller 303 to a gate-on voltage VGL, and converts a high level voltage of the gate timing signal to a gate-off voltage VGH. The level shifter 307 outputs the gate timing signal and the gate voltages VGH and VGL through the gate timing signal output channels and supplies them to the gate driving unit 120.

The power supply unit 304 generates power required for driving the pixel array AA, the gate driving unit 120, and the drive IC 300 of the display panel 100 by using a DC-DC converter. The DC-DC converter may include a charge pump, a regulator, a buck converter, a boost converter, and the like. The power supply unit 304 may adjust a DC input voltage from the host system 200 to generate DC power sources such as the gamma reference voltage, the gate-on voltage VGL, the gate-off voltage VGH, a pixel driving voltage ELVDD, a low potential power voltage ELVSS, an initialization voltage Vini, and the like.

The gamma reference voltage is supplied to the gamma compensation voltage generator 305. The gate-on voltage VGL and the gate-off voltage VGH are supplied to the level shifter 307 and the gate driving unit 120. The pixel power such as the pixel driving voltage ELVDD, the low potential power voltage ELVSS, the initialization voltage Vini, and the like are commonly supplied to the pixels P.

The gate voltage may be set to VGH=15V, VEH=13V, VGL=−6V, VEL=−6V, but is not limited thereto. The pixel power may be set to ELVDD=13V and ELVSS=0V, but is not limited thereto. The voltage ranges of the data voltage Vdata determined by the gamma reference voltage may be Vdata=0 to 5V, but is not limited thereto. The initialization voltage Vini may be set to a DC voltage lower than the data voltage Vdata and lower than the threshold voltage of the light emitting element OLED to suppress light emitting of the light emitting element OLED and to initialize main nodes of the pixels.

The second memory 302 stores compensation values, register setting data, and the like received from the first memory 301 when the power is supplied to the drive IC 300. The compensation value may be applied to various algorithms to improve image quality. The compensation value may include an optical compensation value.

The register setting data may define the operation of the data driving unit 306, the timing controller 303, the gamma compensation voltage generator 305, the power supply 34, and the like, timing of waveform, an output voltage level of the power supply 34. The first memory 301 may include a flash memory. The second memory 302 may include a static RAM (SRAM).

The host system 200 may be any one of a Television (TV) system, a set top box, a navigation system, a personal computer (PC), a home theater system, a vehicle display, a mobile system, and a wearable system.

In the mobile system, the host system 200 may be implemented as an application processor (AP). In the mobile system, the host system 200 may transmit the pixel data of the input image to the drive IC 300 through a Mobile Industry Processor Interface (MIPI). The host system 200 may be connected to the drive IC 300 through, for example, a flexible printed circuit (FPC) 310.

Figure 5:
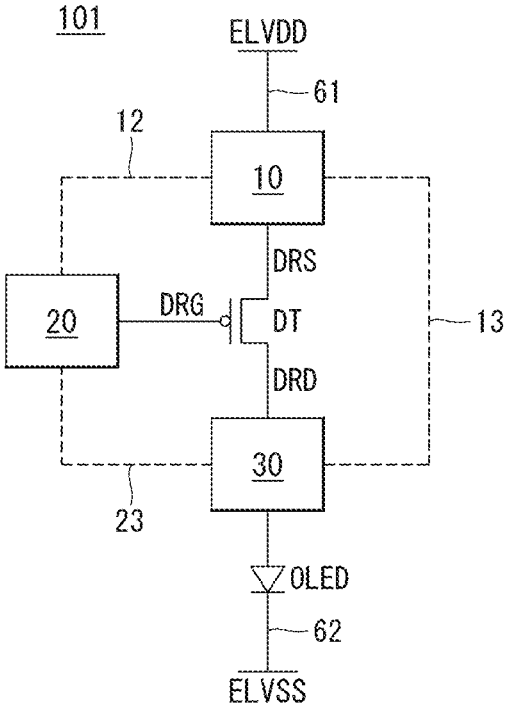
FIG. 5 is a view schematically showing a pixel circuit of the present disclosure.

FIG. 5 is a view schematically showing a pixel circuit of the present disclosure.

Referring to FIG. 5, the pixel circuit may include first to third circuit units 10, 20, and 30, and first to third connection units 12, 23 and 13. In this pixel circuit, one or more components may be omitted or added.

The first circuit unit 10 supplies the pixel driving voltage ELVDD to the driving element DT. The driving element DT may be implemented with a transistor including a gate DRG, a source DRS, and a drain DRD. The second circuit unit 20 charges a capacitor Cst connected to the gate DRG of the driving element DT to maintain the voltage of the capacitor Cst for one frame period. The third circuit unit 30 provides an electric current supplied from the pixel driving voltage ELVDD through the driving element DT to the light emitting element OLED for converting the electric current into light.

The third circuit unit 30 may be connected to a sensing unit that senses in real time a threshold voltage or electrical characteristic variation of the driving element DT.

The first connection unit 12 connects the first circuit unit 10 and the second circuit unit 20. The second connection unit 23 connects the second circuit unit 20 and the third circuit unit 30. The third connection unit 13 connects the third circuit unit 30 and the first circuit unit 10. Each of the first connection unit 12, the second connection unit 23, and the third connection unit 13 may include one or more transistors and wirings.

The internal compensation circuit may be connected to the circuit units 10, 20, 30 and the connection units 12, 23, 13.

Figure 7:
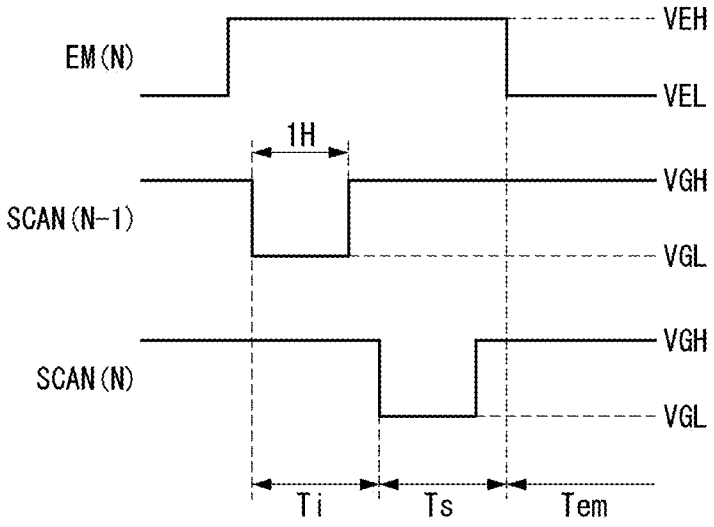
FIG. 7 is a waveform diagram showing a method of driving the pixel circuit shown in FIG. 6.

The pixel circuit may be implemented as the pixel circuit including the internal compensation circuit as shown in FIG. 6. As illustrated in FIG. 7, the pixel circuit may be operated in phases divided into an initialization phase Ti, a data sampling phase Ts, and a light emitting phase Tem.

The pixel circuit shown in FIG. 6 illustrates any sub-pixel circuit belonging to N-th pixel line (N is a natural number). The pixel circuit includes the internal compensation circuit that senses the threshold voltage Vth of the driving element DT and compensates for the gate voltage of the driving element DT by the threshold voltage Vth.

As shown in FIG. 6, the display panel 100 may further include a first power line 61 for supplying the pixel driving voltage ELVDD to the pixels P, a second power line 62 for supplying a low potential power voltage ELVSS to the pixels P, and a third power line 60 for supplying the initialization voltage Vini to the pixels P.

Referring to FIGS. 6 and 7, the pixel circuit includes a light emitting element OLED, a plurality of transistors T1 to T6 and DT, a capacitor Cst, and the like.

The transistors T1 to T6 and DT may be implemented as p-channel transistors. The transistors T1 to T6 and DT may be divided into switch elements T1-T6 and a driving element DT.

The gate signals such as an N−1 scan signal SCAN(N−1), an N scan signal SCAN(N), and an EM signal EM(N) may be applied to the pixel circuit. The pulse of the (N−1)-th scan signal SCAN(N−1) is synchronized with the data voltage Vdata of the (N−1)-th pixel line. The pulse of the N-th scan signal SCAN(N) is synchronized with the data voltage Vdata of the N-th pixel line. The pulse of the N-th scan signal SCAN(N) is generated with the same pulse width as the (N−1)-th scan signal SCAN(N−1), and is generated later than the pulse of the (N−1)-th scan signal SCAN(N−1). The pulse widths of the scan signals SCAN(N−1) and SCAN(N) may be set to one horizontal period 1H.

The driving element DT of the pixel circuit includes first and second driving elements DR1 and DR2 sharing the gate and channel regions. The light emitting element OLED includes an anode and a cathode, and an organic compound layer (EL) formed between the anode and the cathode. The organic compound layer (EL) may include a hole injection layer (HIL), a hole transport layer (HTL), an emission layer (EML), an electron transport layer (ETL) and an electron injection layer (EIL), but is not limited thereto. A capacitor $C_{OLED}$ may be connected between the anode and the cathode of the light emitting element OLED. When an electric current flows through the light emitting element OLED, the holes passing through the hole transport layer (HTL) and the electrons passing through the electron transport layer (ETL) may be moved to the light emitting layer (EML) to generate excitons, and as a result, the visible light may be emitted from light emitting layer (EML).

The pixel circuit includes first to fourth nodes n1 to n4. The first node n1 is connected to the capacitor Cst, the first electrode of the first switch element T1, the second electrode of the fifth switch element T5, and the gate of the driving element DT. The second node n2 is connected to the second electrode of the third switch element T3 and the first electrode of the second driving element DR2. The third node n3 is connected to the second electrode of the second driving element DR2 and the first electrode of the fourth switch element D4. The fourth node n4 is connected to the second electrode of the fourth switch element T4, the second electrode of the sixth switch element T6, and the anode of the light emitting element OLED.

The pixel driving voltage ELVDD is supplied to the pixels P through the first power line 61. The capacitor Cst is connected between the first power line 61 and the first node n1.

The first switch element T1 is turned on according to the gate-on voltage VGL of the N scan signal SCAN(N) to connect the gate of the first driving element DR1 and the second electrode. The first switch element T1 includes a gate connected to the second gate line 53, a first electrode connected to the first node n1, and a second electrode connected to the second electrode of the first driving element DR1.

The second switch element T2 is turned on according to the gate-on voltage VGL of the N scan signal SCAN(N) to connect the data line 51 to the first electrode of the first driving element DR1. The second switch element T2 includes a gate connected to the second gate line 53, a first electrode connected to the data line 51, and a second electrode connected to the first electrode of the first driving element DR1.

The third switch element T3 is turned on according to the gate-on voltage VEL of the EM signal EM(N) to connect the first power line 61 to which the pixel driving voltage ELVDD is applied to the first electrode of the driving element DR2. The EM signal EM(N) is supplied to the pixels P through the third gate line 54. The third switch element T3 includes a gate connected to the third gate line 54, a first electrode connected to the first power line 61, and a second electrode connected to the second node n2.

The fourth switch element T4 is turned on according to the gate-on voltage VEL of the EM signal EM(N) to connect the second electrode of the second driving element DR2 to the anode of the light emitting element OLED. The gate of the fourth switch element T4 is connected to the third gate line 54. The first electrode of the fourth switch element T4 is connected to the third node n13, and the second electrode of the fourth switch element T4 is connected to the anode of the light emitting element OLED via the fourth node n14.

The fifth switch element T5 is turned on according to the gate-on voltage VGL of the (N−1)-th scan signal SCAN(N−1) to connect the third power line 60 to the first node n1, such that the capacitor Cst and the gate of the driving element DT are initialized in the initialization phase Ti. The (N−1)-th scan signal SCAN(N−1) is supplied to the pixels P through the first gate line 52. The initialization voltage Vini is supplied to the pixels P through the third power line 60. The fifth switch element T5 includes a gate connected to the first gate line 52, a first electrode connected to the third power line 60, and a second electrode connected to the first node n1.

The sixth switch element T6 is turned on according to the gate-on voltage VGL of the N scan signal SCAN(N) to connect the third power line 60 to the anode of the light emitting element OLED in the data sampling phase Ts. In the data sampling phase Ts, the light emitting element OLED does not emit light because the voltage between the anode and the cathode is less than its threshold voltage. The sixth switch element T6 includes a gate connected to the second gate line 53, a first electrode connected to the third power line 60, and a second electrode connected to the fourth node n4.

The first driving element DR1 is turned on in the data sampling phase Ts. The first driving element DR1 includes a gate connected to the first node n1, a first electrode connected to the second electrode of the second switch element T2, and a second electrode connected to the second electrode of the first switch element T1.

The second driving element DR2 drives the light emitting element OLED by adjusting an electric current flowing in the light emitting element OLED according to the gate-source voltage Vgs in the light emitting phase Tem. The second driving element DR2 includes a gate connected to the first node n1, a first electrode connected to the second node n2, and a second electrode connected to the third node n3.

The first and second driving elements DR1 and DR2 share a channel in which electric current flows by sharing the gate. The threshold voltages of the first and second driving elements DR1 and DR1 may be set substantially the same.

The operation of the internal compensation circuit of the pixel circuit may be divided into an initialization phase Ti in which main nodes of the pixel circuit are initialized, a data sampling phase Ts in which the threshold voltage of the first driving element DR1 is sensed, and a gate voltage of the driving element DT is compensated by the threshold voltage, and a light-emitting phase Tem in which the light emitting element OLED emits light with an electric current flowing according to the gate-source voltage Vgs of the second driving element DR2.

In the initialization phase Ti, the (N−1)-th scan signal SCAN(N−1) is generated with a pulse of the gate-on voltage VGL to supply it to the first gate line 52. As a result, the fifth switch element T5 is turned on in the initialization phase Ti so that the first node n1, the capacitor Cst, and the gates of the driving elements DR1 and DR2 are discharged until the initialization voltage Vini. As a result, the capacitor Cst and the gate voltages of the driving elements DR1 and DR1 are discharged to the initialization voltage Vini in the initialization phase Ti.

In the data sampling phase Ts, the data voltage Vdata of the pixel data is supplied to the data line 51. The N-th scan signal SCAN(N) is generated with a pulse of the gate-on voltage VGL synchronized with the data voltage Vdata to be supplied to the second gate line 53. As a result, in the data sampling phase Ts, the first, second, and sixth switch elements T1, T2, and T6 are turned on. In this case, the data voltage Vdata is applied to the first node n1, and the voltage of the first node n1 is changed from Vini to Vdata−|Vth| The data voltage Vdata, which has been compensated by the threshold voltage Vth of the driving elements DR1 and DR2 sensed in the data sampling phase Ts, is charged in the capacitor Cst. Therefore, even if there is a deviation in the threshold voltage Vth of the driving element DT between pixels or a variation in the time course of the threshold voltage Vth occurs, the gate voltage of the driving element DT may be compensated by the threshold voltage Vth.

In the initialization phase Ti and the data sampling phase Ts, the EM signal EM(N) maintains the gate-off voltage VEH. In this periods Ti and Ts, since the third and fourth switch elements T3 and T4 remain off state, no current flows through the light emitting element OLED.

In the light emitting phase Tem, the voltage of the EM signal EM(N) is changed to the gate-on voltage VEL. As a result, the third and fourth switch elements T13 and T14 are turned on in the light emitting phase Tem. In this case, a current generated in accordance with the gate-source voltage Vgs of the second driving element DR2 stored in the capacitor Cst in the light emitting phase Tem flows through the light emitting element OLED so that the light emitting element OLED may emit light.

The amount of current flowing through the light emitting element OLED is adjusted according to the gate-source voltage Vgs of the second driving element DR2. The gate-source voltage Vgs of the second driving element DR2 is Vgs=Vdata−|Vth|−ELVDD in the light emitting phase Tem. In order to accurately express the luminance of the low gradation, the EM signal EM(N) may be transitioned between the gate-on voltage VEL and the gate-off voltage VEH at a predetermined duty ratio in the light emitting phase Tem.

Figure 8:
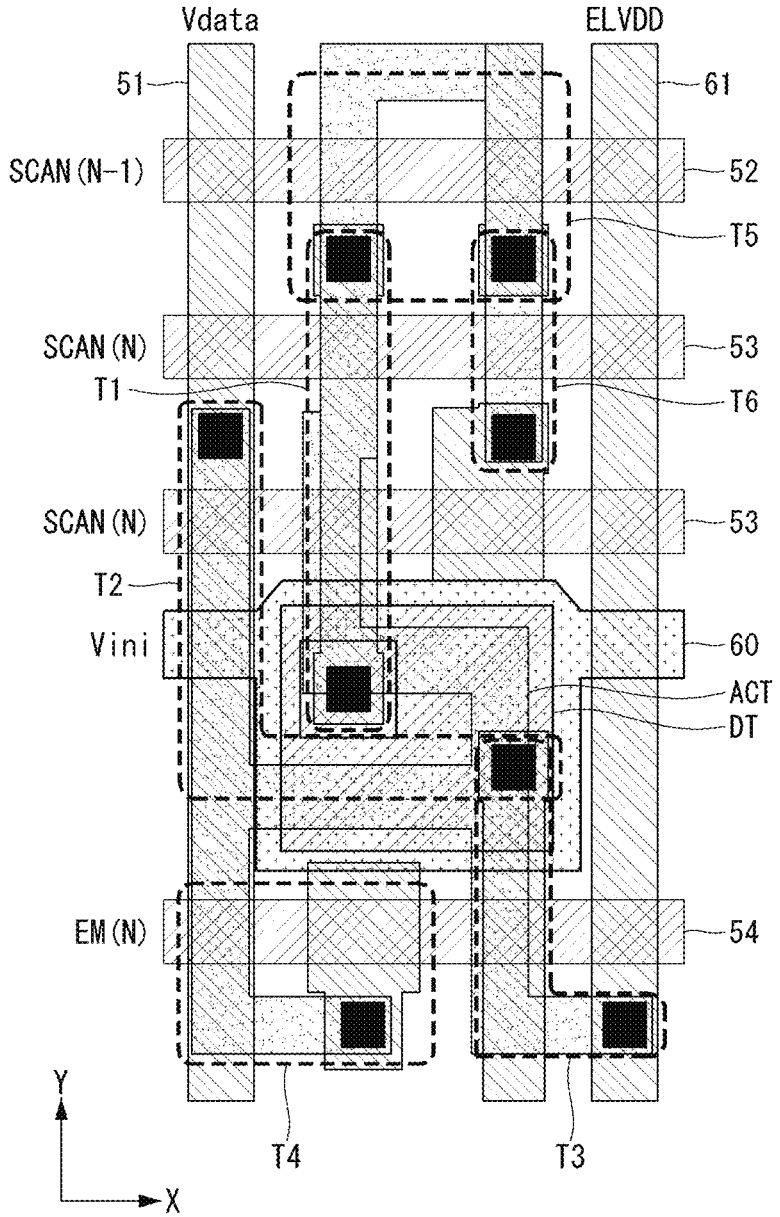
FIG. 8 is a plan view showing a layout of the pixel circuit shown in FIG. 6.
Figure 9:
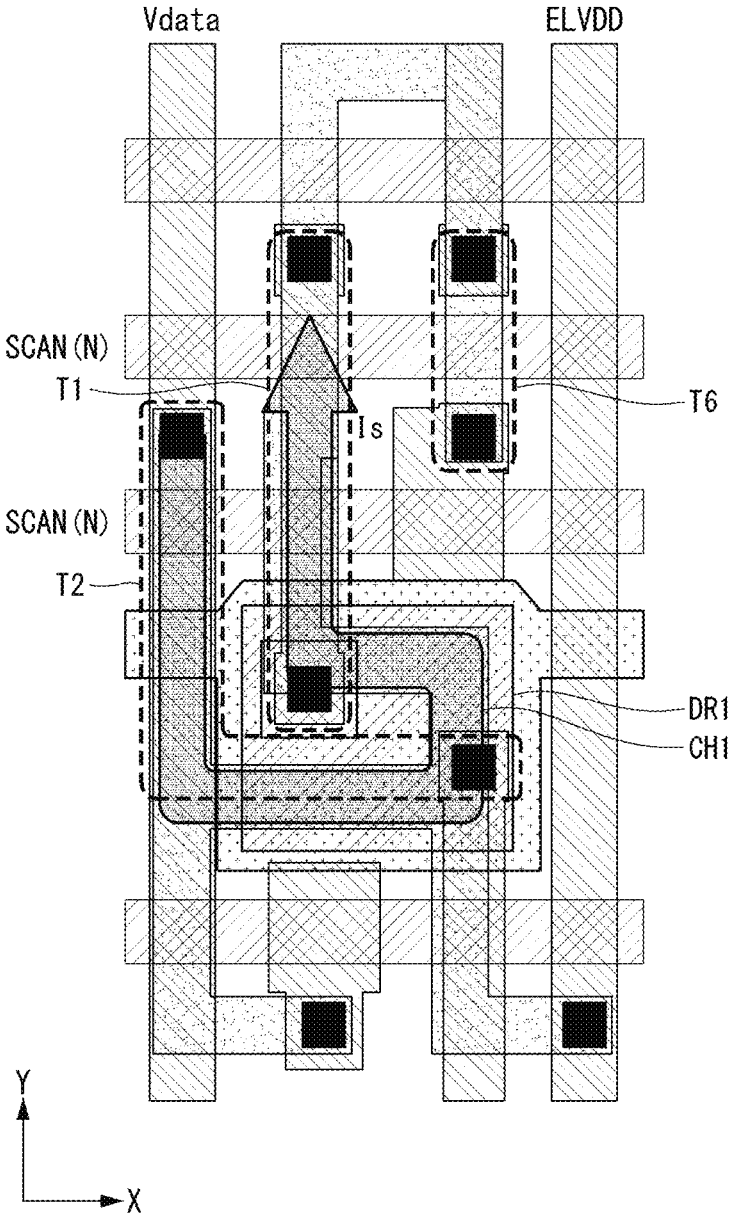
FIG. 9 is a diagram showing an effective channel in which electric current flows in a channel on an active pattern of a driving element in a data sampling phase.
Figure 10:
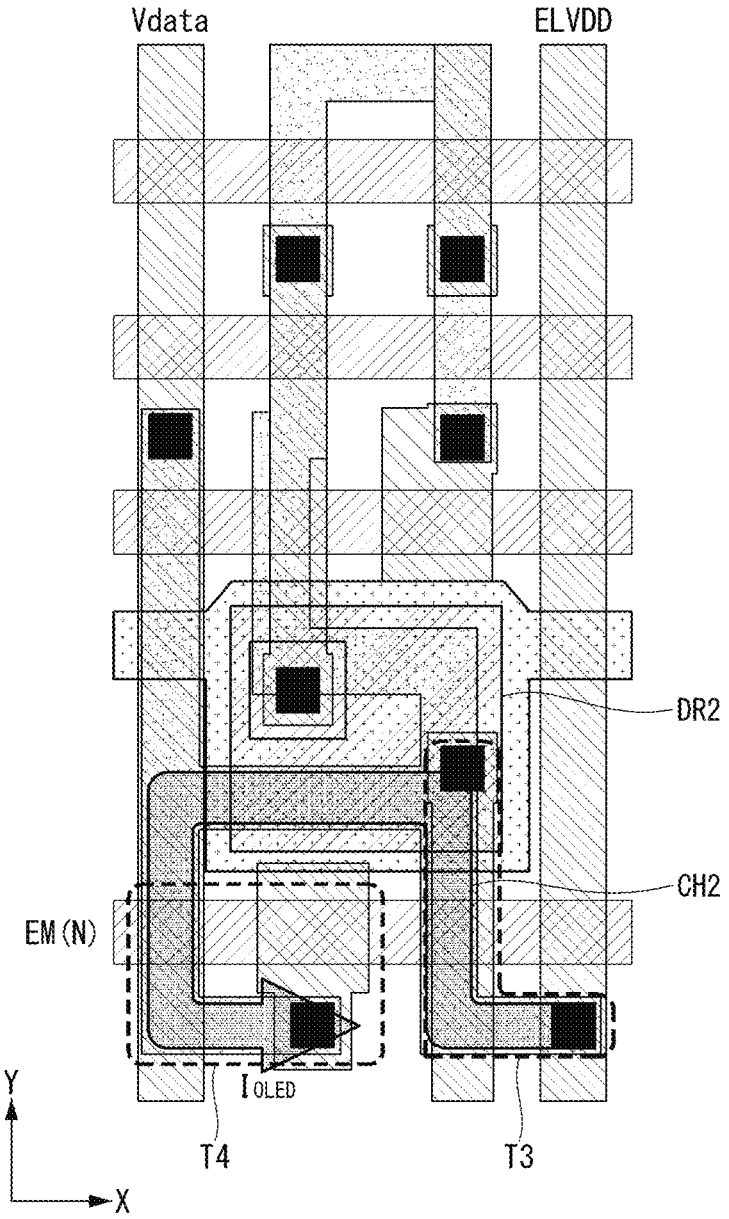
FIG. 10 is a diagram showing an effective channel in which electric current flows in a channel on an active pattern of a driving element in the data sampling phase.

FIG. 8 is a plan view showing a layout of the pixel circuit shown in FIG. 6. FIG. 9 is a diagram showing an effective channel in which a current Is flows in a channel on an active pattern of the driving element DT in the data sampling phase Ts. FIG. 10 is a diagram showing an effective channel in which a current $I_{OLED}$ flows in a channel on the active pattern of the driving element DT in the light emitting stage Tem.

Referring to FIGS. 8 to 10, the driving element DT includes an active pattern ACT made of a semiconductor. The gates of the first and second driving elements DR1 and DR2 share the active pattern ACT. On the active pattern ACT, two effective channels CH1 and CH2 having different paths in which currents Is and $I_{OLED}$ flow are formed.

In the data sampling phase Ts, the current Is flows along the first effective channel CH1 of the active pattern ACT. In this case, the current Is flows from the second switch element T2 to the first switch element T1. The first effective channel CH1 is formed along a long path that is bent one or more times within the driving element DT, so that its length is set to be long. Accordingly, in accordance with the present disclosure, a current variation of the driving element DT may be reduced by a process spread by increasing a length of an effective channel in the data sampling phase Ts, such that data sampling between pixels may be uniformly achieved.

In the light emitting phase Tem, the current $I_{OLED}$ flows along the second effective channel CH of the active pattern ACT. In this case, the current $I_{OLED}$ flows from the third switch element T3 to the fourth switch element T4. The second effective channel CH2 is formed along a short path in the driving element DT and is set to be shorter in length compared to the first effective channel CH1. Thus, in accordance with the present disclosure, the length of the effective channel may be shortened in the light emitting phase (Tem), thereby rapidly increasing an on-current to speed up the charging of the anode of the light emitting element OLED. Accordingly, the anode voltage of the light emitting element OLED may rapidly reach the threshold voltage of the light emitting element OLED in the light emitting phase Tem.

Figure 11:
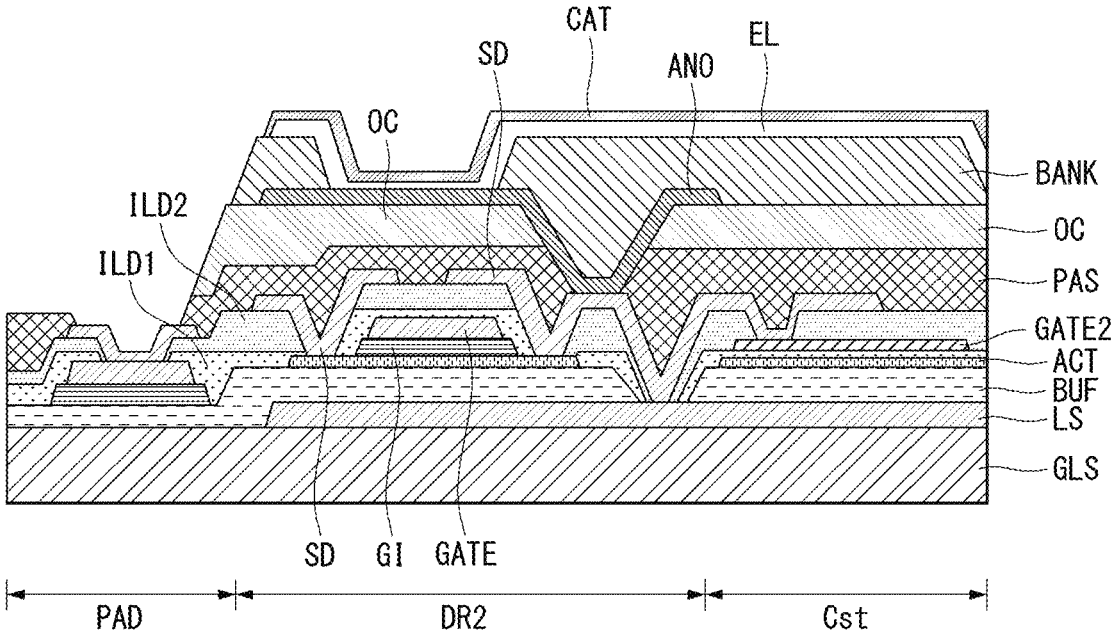
FIG. 11 is a cross-sectional view showing an example of a cross-sectional structure of a TFT, a capacitor, and a pad formed on a pixel array substrate.

FIG. 11 is a cross-sectional view showing an example of a cross-sectional structure of a second driving element DR, a capacitor Cst, and a pad PAD formed on a pixel array substrate.

Referring to FIG. 11, a first metal pattern LS is formed on the substrate GLS. The substrate GLS may be an organic thin film, for example, a polyimide film.

The first metal pattern LS is disposed under the driving element DR2 to block light emitted from the driving element DR2. A buffer layer BUF is formed of an inorganic insulating material, for example, SiO2, SiNx, and the like, to cover the metal pattern LS. A portion of the active pattern ACT may be used as a dielectric layer of the capacitor Cst. When the driving element DR2 is implemented as an oxide driving element DR2, the active pattern ACT may include an indium gallium zinc oxide IGZO.

A gate insulating layer GI is formed on the active pattern ACT. The gate insulating layer GI may be formed of an inorganic insulating material. First and second interlayer insulating layers ILD1 and IDD2 are disposed between a first gate metal pattern GATE and a source-drain metal pattern SD such that the metal patterns may be insulated from each other.

In the capacitor Cst, a second gate metal pattern GATE2 is formed on the first interlayer insulating layer ILD1. The second gate metal pattern GATE2 includes the lower electrode of the capacitor Cst.

The gate metal pattern GATE is disposed on the pad PAD and the driving element DR2. The gate metal pattern GATE disposed on the pad PAD includes a lower pad electrode. The gate metal pattern GATE disposed on the driving element DR2 includes a gate electrode of the driving element DR2.

The source-drain metal pattern SD is disposed on the pad PAD, the driving element DR2, and the capacitor Cst. The source-drain metal pattern SD disposed on the pad PAD includes an upper pad electrode which is in contacted with the gate metal pattern GATE through a contact hole passing through the first and second interlayer insulating layers ILD1 and ILD2. The upper pad electrode may be connected to the output terminal of the drive IC 300 through an anisotropic conductive film (ACF).

The source-drain metal pattern SD disposed on the driving element DR2 includes a source electrode and a drain electrode of the driving element DR2. The source-drain metal pattern SD disposed on the capacitor Cst includes an upper electrode of the capacitor Cst. The source electrode and the drain electrode are in contacted with the active pattern ACT through contact holes passing through the first and second interlayer insulating layers ILD1 and ILD2

A passivation layer PAS covers the driving element DR2 and the capacitor Cst. The passivation layer PAS may be formed of an inorganic insulating material. A planarization layer OC covers the passivation layer PAS to flatten the surface thereof. The planarization layer OC may be formed of an organic insulating material.

An anode electrode ANO of the light emitting element OLED is disposed on the planarization layer OC to be in contacted with the source-drain metal pattern of the driving element DR2 through a contact hole passing through the passivation layer PAS and the planarization layer OC. The anode electrode ANO may include a transparent electrode material such as Indium Tin Oxide (ITO). A bank pattern BANK is formed of an organic insulating material and is disposed on the planarization layer OC and the anode electrode ANO to define a light emitting region. The organic compound layer EL of the light emitting element OLED is disposed on an exposed region of the anode electrode defined by the bank pattern BANK, and is disposed on the bank pattern BANK. A cathode electrode CAT of the light emitting element OLED is disposed on the organic compound layer EL. The cathode electrode may include a transparent metal electrode material such as Indium Zinc Oxide (IZO).

Figure 12:
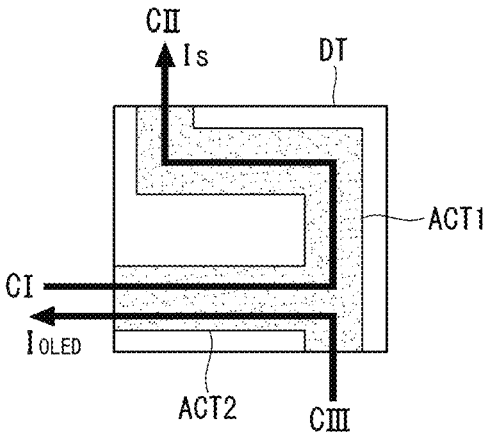
FIG. 12 is a plan view showing an enlarged planar structure of an active pattern in a driving element DT.

FIG. 12 is a plan view showing an enlarged planar structure of an active pattern ACT in the driving element DT.

Referring to FIG. 12, the active pattern ACT includes a first pattern ACT1 that is bent at least once in a channel region of the driving element DT and a short second pattern ACT2 branched from the first pattern ACT1.

The first pattern ACT1 is connected between an upper CII point and a lower CIII point in the channel region of the driving element DT and is bent one or more times to include a vertical line portion and a horizontal line portion. The second pattern ACT2 includes a horizontal line portion passing through a CI point on the left or right side in the channel region of the driving element DT. The horizontal line portion of the second pattern ACT2 is branched from the vertical line portion of the first pattern ACT1.

In the data sampling phase Ts, a first effective channel CH1 in which the current Is flows in the driving element DT includes a long current path including the first pattern ACT1 and the second pattern ACT2 between the CI point and the CII point. The current Is flows from CI point to CII point. Thus, the first effective channel CH1 passes through the second pattern ACT2 and the first pattern ACT1 between the CI point and the CII point.

In the light emitting phase Tem, a second effective channel CH2 in which the current $I_{OLED}$ flows in the driving element DT includes a short current path including the first pattern ACT1 and the second pattern ACT2 between the CI point and the CIII point. The current $I_{OLED}$ flows from CIII point to CI point.

FIGS. 13A to 13F are plan views showing the planar structure of each layer in detail by separating thin film layer patterns constituting a pixel circuit for each layer.

Figure 13A:
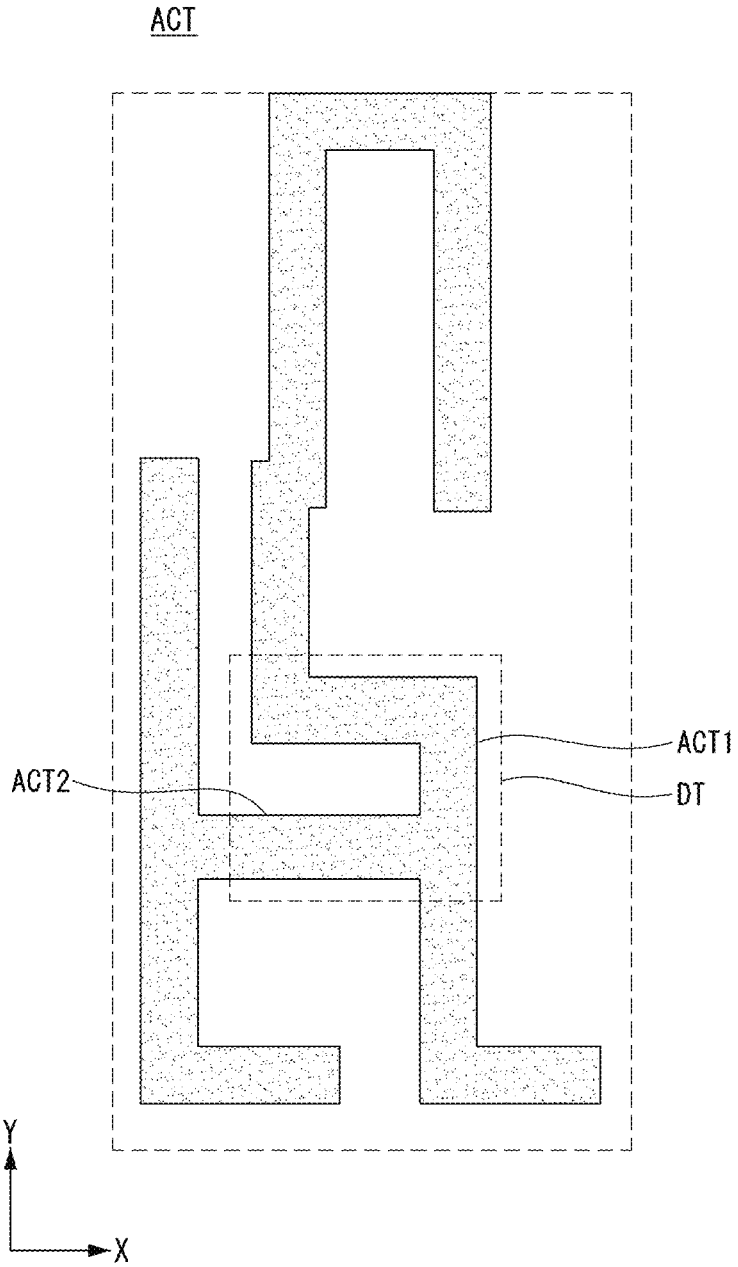
FIGS. 13A to 13F are plan views showing the planar structure of each layer in detail by separating thin film layer patterns constituting a pixel circuit for each layer.
Figure 13B:
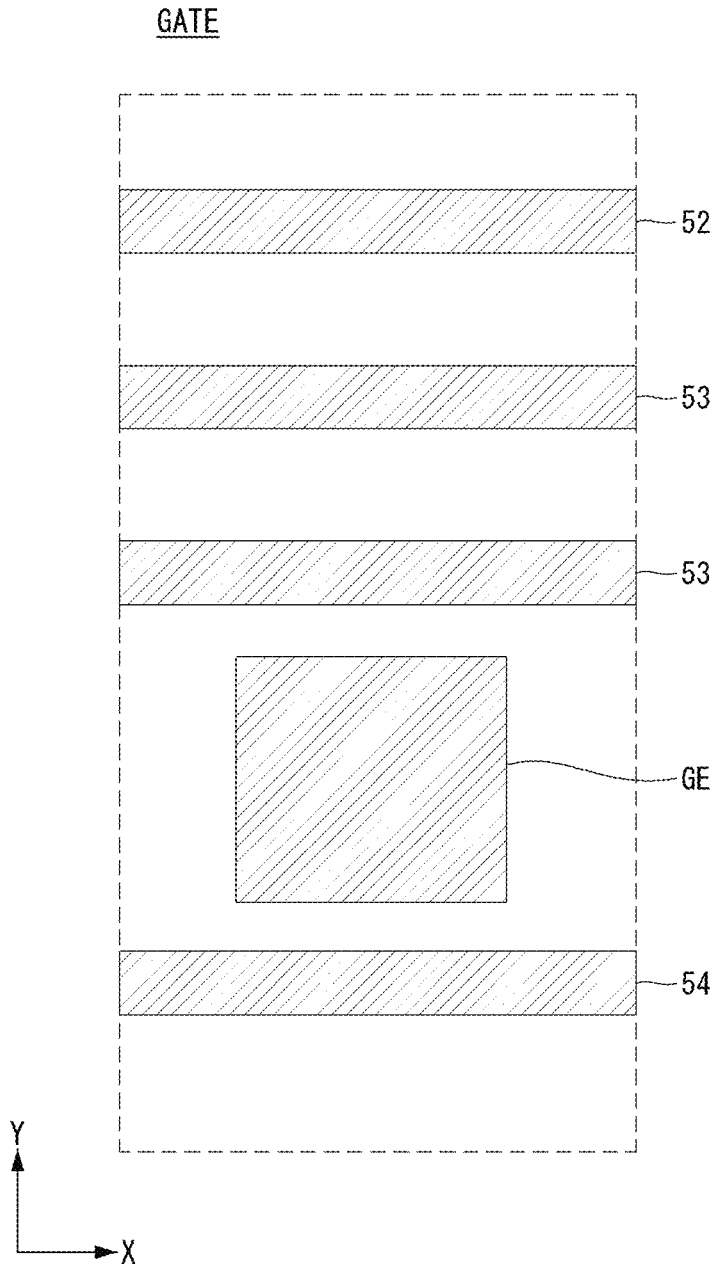

As in the example of FIG. 13A, a semiconductor pattern ACT includes first and second patterns ACT passing through channel regions of the switch elements T1 to T6T and the driving element DT. As in the example of FIG. 13B, the gate metal pattern GATE includes gate lines 52 to 54, the switch elements T1 to T6, and a gate electrode GE of the driving element DT.

Figure 13C:
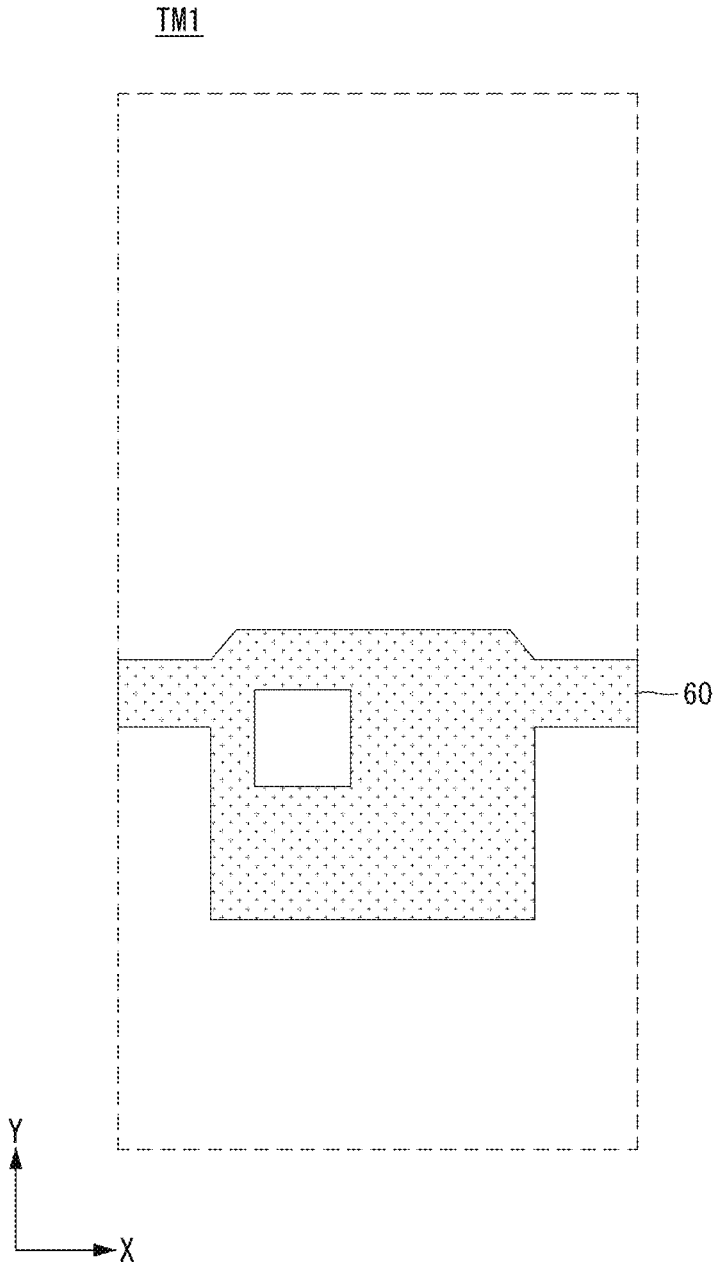
Figure 15:
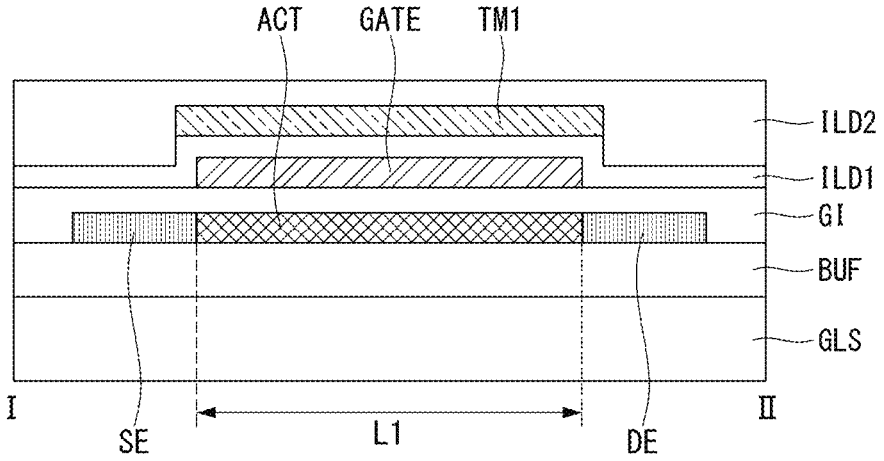
FIG. 15 is a cross-sectional view showing a cross-sectional structure of the first effective channel taken along the line 'I-II" in FIG. 14.
Figure 17:
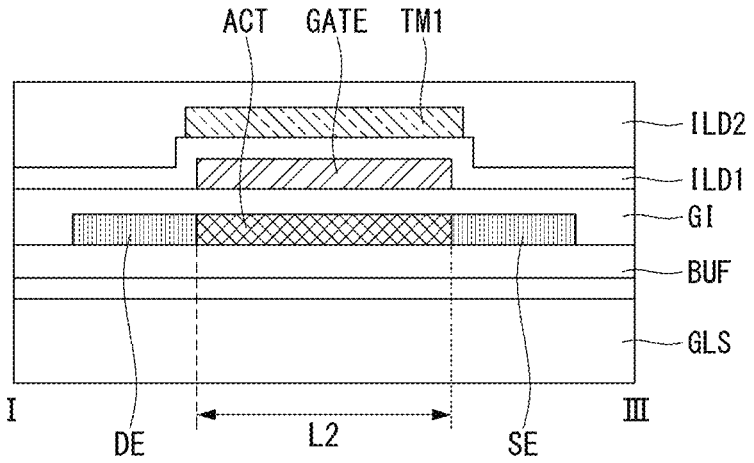
FIG. 17 is a cross-sectional view showing a cross-sectional structure of the second effective channel taken along the line "I-III" in FIG. 16.

A third power line 60 may be formed of a metal pattern TM1 shown in FIGS. 13C, 15 and 17. The metal pattern TM1 is a third metal pattern between the gate metal pattern GATE and the source-drain metal pattern SD.

Figure 13D:
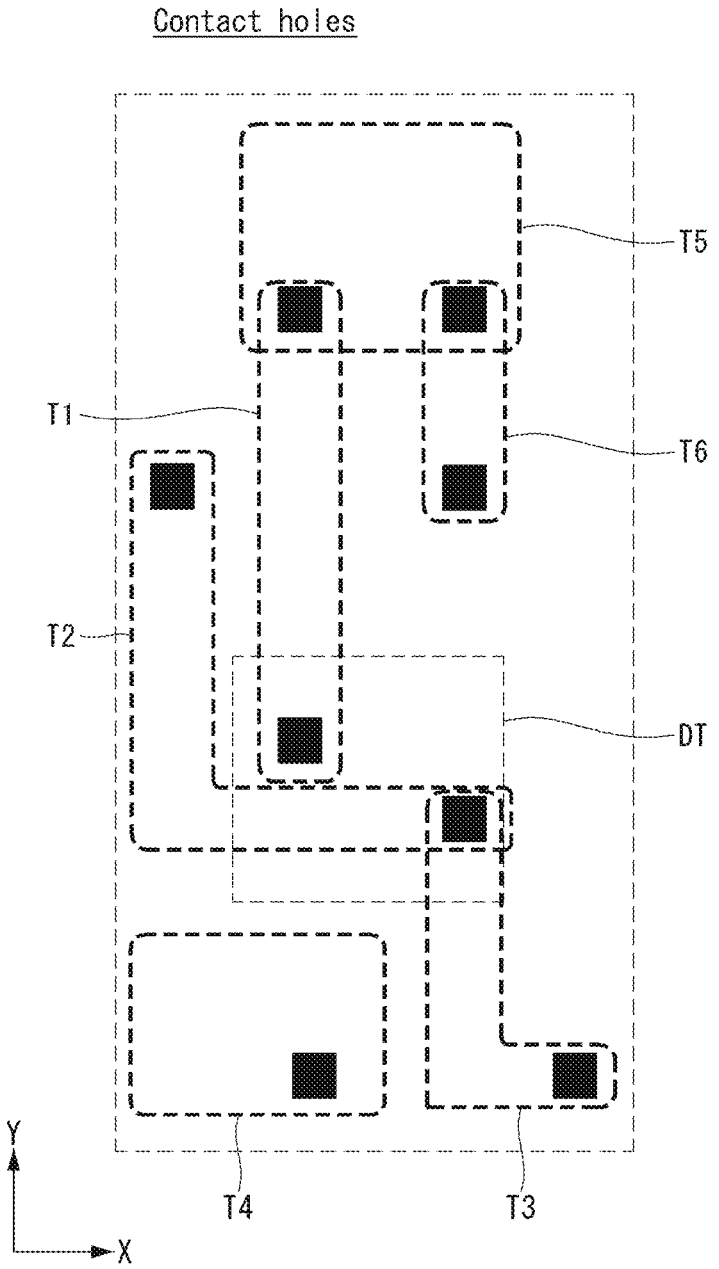

The circuit components constituting the pixel array include a plurality of contact holes that connect the metal patterns GATE, TM1 and SD through one or more insulating layers. In FIG. 13D, a square box represents contact holes of the pixel circuit shown in FIG. 6.

Figure 13E:
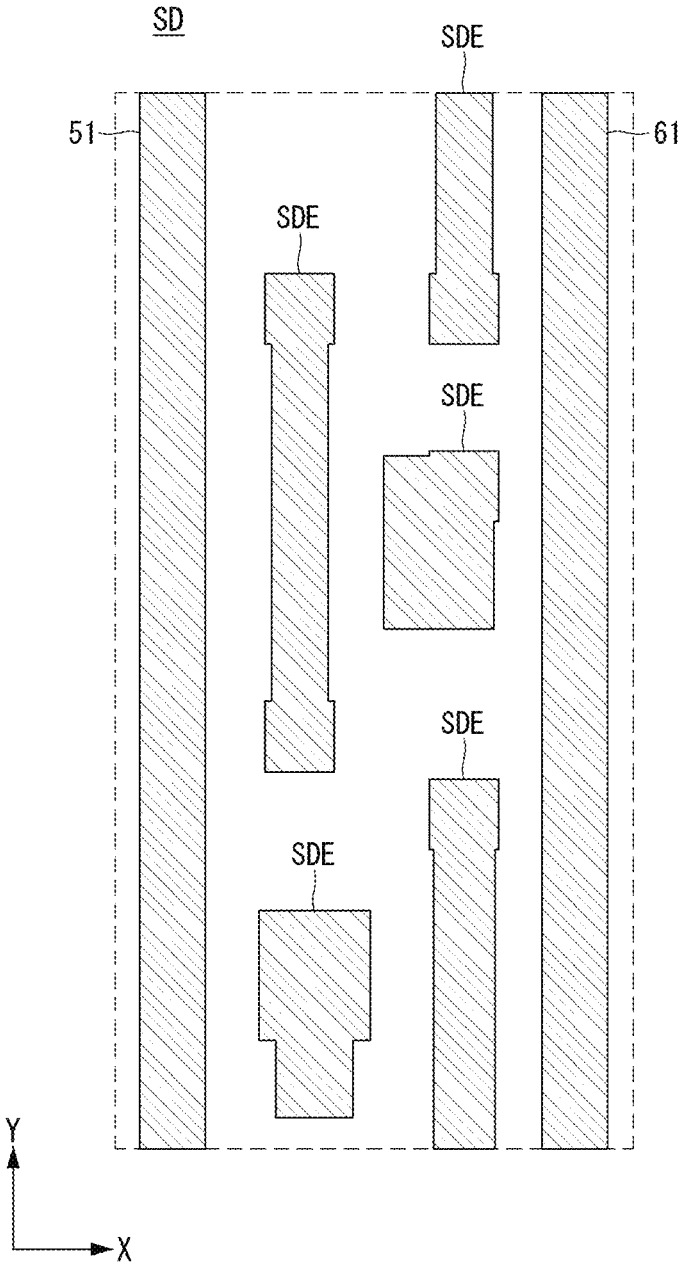
Figure 13F:
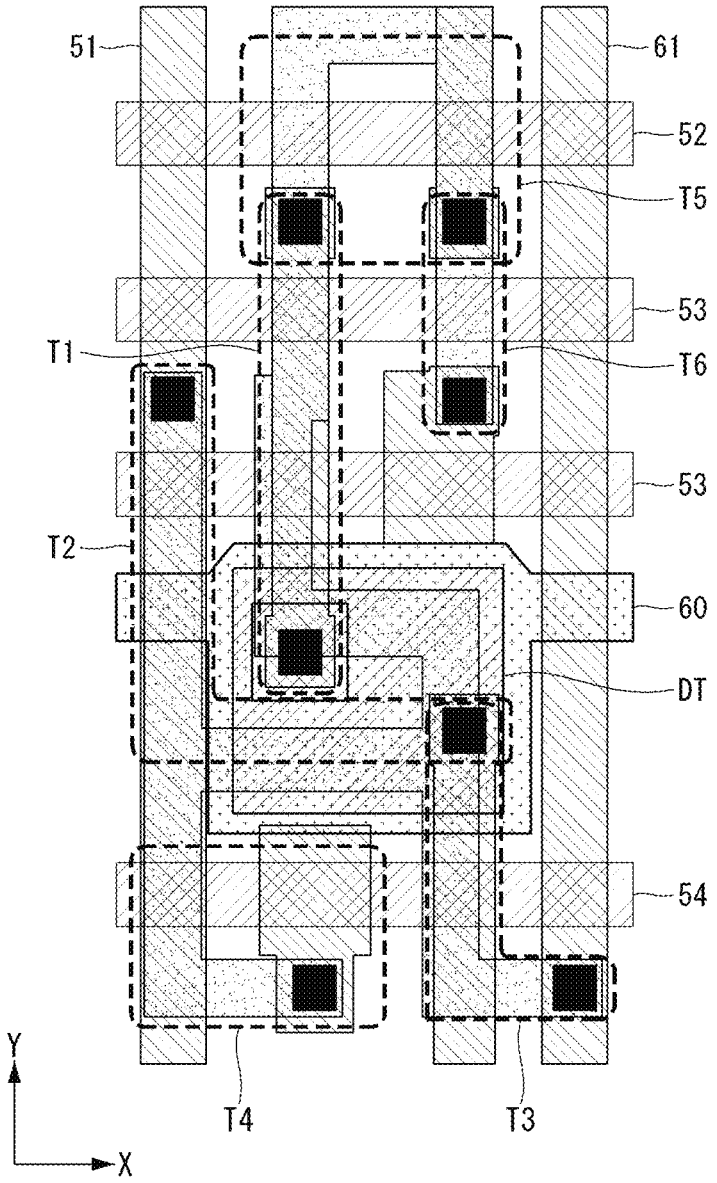

As shown in FIG. 13E, the source-drain metal pattern SD includes a first power line 61, a data line 51, and source and drain electrodes SDE of the switch elements T1 to T6 and the driving element DT. FIG. 13F shows a planar structure of the pixel circuit in which the thin film layers shown in FIGS. 13A to 13E are stacked.

Figure 14:
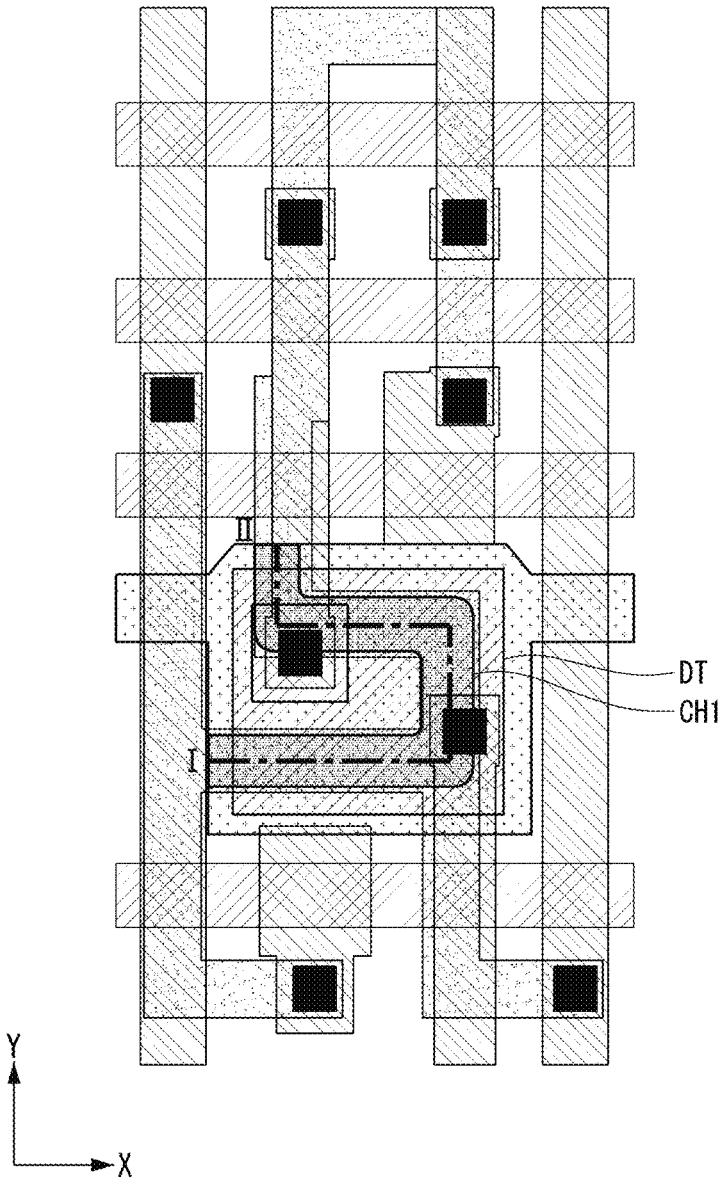
FIG. 14 is a plan view showing a first effective channel of the driving element DT in the data sampling phase.

FIG. 14 is a plan view showing a first effective channel CH1 of the driving element DT in the data sampling phase Ts. FIG. 15 is a cross-sectional view showing a cross-sectional structure of the first effective channel taken along line "I-II" in FIG. 14. As shown in FIGS. 14 and 15, the first effective channel CH1 includes a long current path that is bent two or more times in an active pattern in a channel region of the driving element DT.

Figure 16:
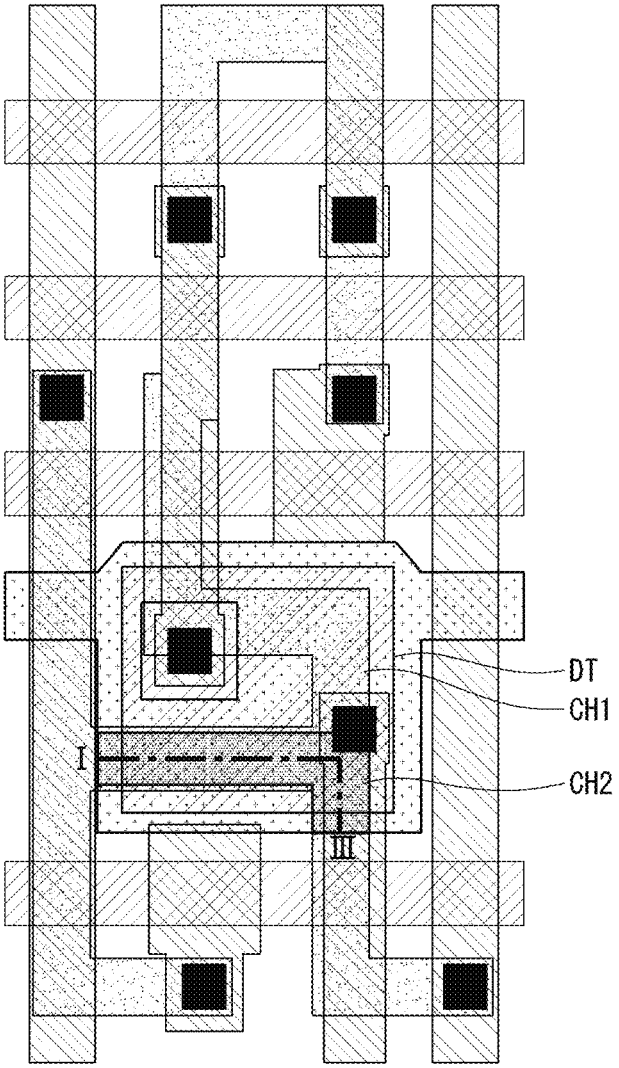
FIG. 16 is a plan view showing a second effective channel of the driving element DT in a light emitting phase.

FIG. 16 is a plan view showing a second effective channel of the driving element DT in the light emitting phase Tem. FIG. 17 is a cross-sectional view showing a cross-sectional structure of the second effective channel taken along line "I-III" in FIG. 16. As shown in FIGS. 16 and 17, the second effective channel CH2 includes a relatively short current path in the active pattern in the channel region of the driving element DT. The length L2 of the second effective channel CH2 is shorter than the length L1 of the first effective channel CH1. For example, L2 may be set to a length of ½ or less of L1.

Figure 18:
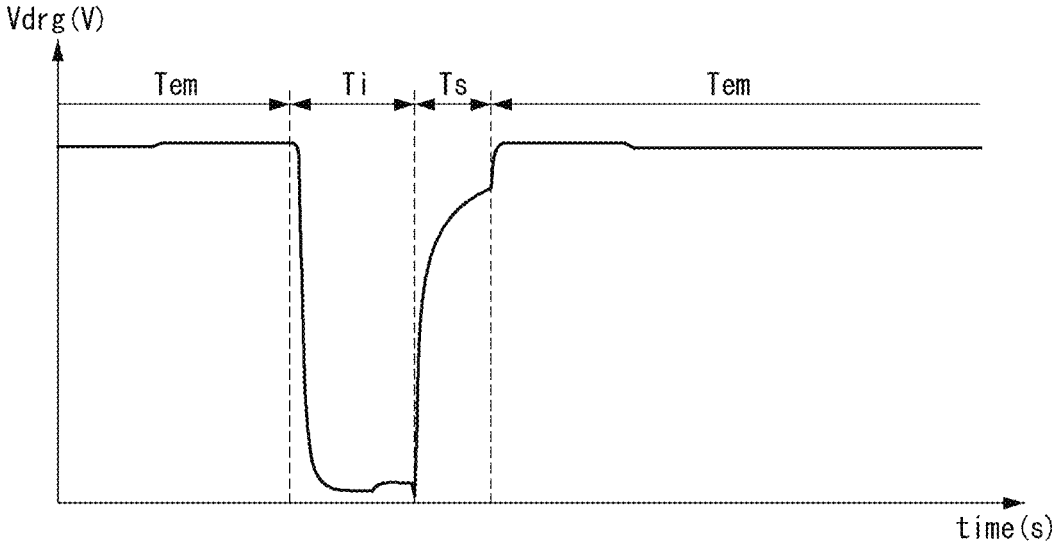
FIG. 18 is a simulation result diagram showing the gate voltage of the driving element when a length of an effective channel of the driving element is 25 μm.
Figure 19:
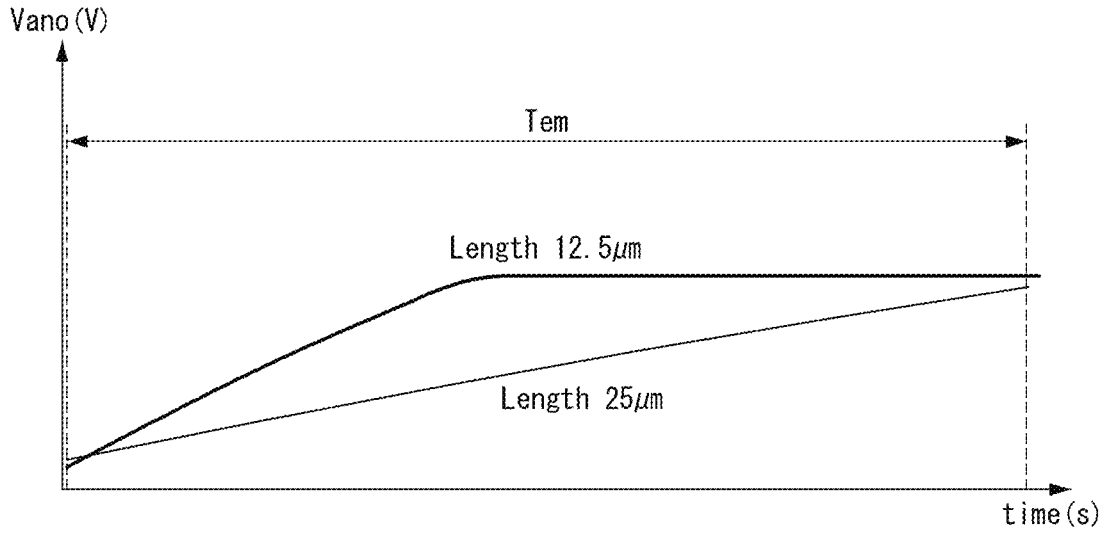
FIG. 19 is a simulation result diagram showing the anode voltage of the light emitting element when a length of an effective channel of the driving element is 12.5 μm and 25 μm in the light emitting phase.
Figure 20:
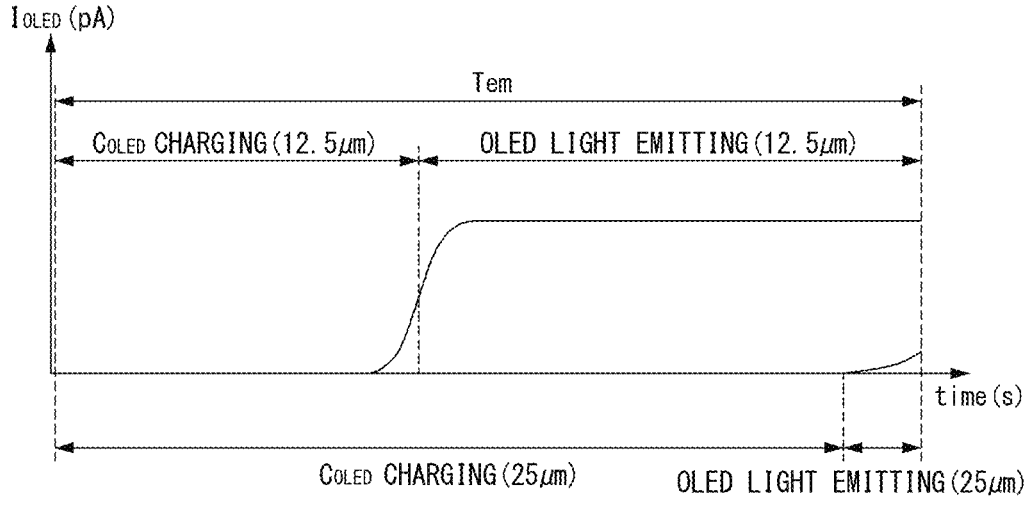
FIG. 20 is a simulation result diagram showing a electric current of the light emitting element when a length of an effective channel of the driving device is 12.5 μm and 25 μm in the light emitting phase.

FIG. 18 is a simulation result diagram showing the gate voltage Vdrg(V) of the driving element DT when the length of the effective channel of the driving element is 25 μm. FIG. 19 is a simulation result diagram showing the anode voltage Vano (V) of the light emitting element OLED in the light emitting phase Tem when the length of the effective channel of the driving device DT is 12.5 μm and 25 μm. FIG. 20 is a simulation result diagram showing a current $I_{OLED}$ (pA) of the light emitting element OLED when the length of the effective channel of the driving element in the light emitting phase Tem is 12.5 μm and 25 μm. As can be seen from FIGS. 19 and 20, when the length of the effective channel of the driving element DT is shortened in the light emitting phase Temp, the anode voltage of the light emitting element OLED and the voltage of the capacitor $C_{OLED}$ are increased. As a result, the On-current Ion of the light emitting element OLED in the light emitting phase Tem may increase faster.

As described above, the effective channels in which the current flow in the active pattern of the driving element may be designed with a long path and a short path. Thus, it is possible to reduce the current and voltage fluctuations of the elements due to the process spread by lengthening the channel length, and to increase the on-current by reducing the length of the effective channel in the light emitting phase. As a result, it is possible to rapidly increase the anode voltage charging of the light emitting element in the light emitting phase.

The effects of the present disclosure are not limited to the above-mentioned effects, and other effects not mentioned will be clearly understood by those skilled in the art from the description of the claims.

It will be apparent to those skilled in the art that various modifications and variations can be made in the display device and the driving method thereof of the present disclosure without departing from the technical idea or scope of the disclosure. Thus, it is intended that the present disclosure cover the modifications and variations of this disclosure provided they come within the scope of the appended claims and their equivalents.

What is claimed is:

1. A display device, comprising:

a pixel circuit including a driving element for driving a light emitting element, wherein a channel region of the driving element includes:

a first active pattern; and a second active pattern branching from the first active pattern, wherein a branch point, at which the second active pattern branches from the first active pattern, is located in the channel region of the driving element.

2. The display device according to claim 1, wherein:

the first active pattern is bent at least once in the channel region of the driving element; and the second active pattern has a shorter length than the first active pattern in the channel region of the driving element.

3. A display device comprising:

a pixel circuit including a driving element for driving a light emitting element, the driving element comprising:

an active pattern including:

first and second effective channels; and different lengths of a current path, wherein the active pattern includes:

a first active pattern that is bent at least once in a channel region of the driving element; and a second active pattern branching from the first active pattern in the channel region of the driving element, the second active pattern having a shorter length than the first active pattern, wherein the second active pattern includes a horizontal line portion passing through a first point on a left or right side of the channel region, wherein the first active pattern passes through a second point on an upper side and a third point on a lower side of the channel region, wherein the first active pattern is bent at least once between the second point and the third point, and wherein a length of the second active pattern in the channel region is shorter than a length of the first active pattern.

4. The display device according to claim 3, wherein the horizontal line portion of the second active pattern branches from a vertical line portion of the first active pattern in a horizontal direction.

5. The display device according to claim 3, wherein:

the first effective channel passes through the first and second active patterns between the first point and the second point; and the second effective channel passes through the first and second active patterns between the first point and the third point.

6. The display device according to claim 5, wherein:

a data voltage is to be applied to a gate of the driving element and a current is to flow in the first effective channel during a data sampling phase;

an electric current is to flow in the second effective channel during a light emitting phase;

the electric current generated through the first effective channel in the data sampling phase is to flow from the first point to the second point; and the electric current generated through the second effective channel in the light emitting phase is to flow from the third point to the first point.

7. The display device according to claim 6, wherein the driving element includes first and second driving elements sharing the gate and the channel region.

8. The display device according to claim 7, further comprising:

a first gate line to which (N−1)-th scan signals are to be applied (N is a natural number);

a second gate line to which N-th scan signals generated subsequent to the (N−1)-th scan signals are to be applied;

a third gate line to which an emitting control signal is to be applied;

a data line to which a data signal is to be applied;

a first power line to which a predetermined pixel driving voltage is to be applied;

a second power line to which a predetermined low potential power voltage is to be applied; and a third power line to which a predetermined initialization voltage is to be applied, wherein the gate lines, the data line, and the power lines are connected to the pixel circuit.

9. The display device according to claim 8, wherein the pixel circuit further comprises:

a first switch element including:

a gate connected to the second gate line;

a first electrode connected to a first node; and a second electrode connected to a second electrode of the first driving element;

a second switch element including:

a gate connected to the second gate line;

a first electrode connected to the data line; and a second electrode connected to the first electrode of the first driving element;

a third switch element including:

a gate connected to the third gate line;

a first electrode connected to the first power line; and a second electrode connected to a second node;

a fourth switch element including:

a gate connected to the third gate line;

a first electrode connected to a third node; and a second electrode connected to an anode of the light emitting element via a fourth node;

a fifth switch element including:

a gate connected to the first gate line;

a first electrode connected to the third power line; and a second electrode connected to the first node;

a sixth switch element including:

a gate connected to the second gate line;

a first electrode connected to the third power line; and a second electrode connected to the fourth node.

10. The display device according to claim 9, wherein:

the first driving element includes:

a gate connected to the first node;

a first electrode connected to a second electrode of the second switch element; and a second electrode connected to a second electrode of the first switch element, the second driving element includes:

a gate connected to the first node, a first electrode connected to the second node; and a second electrode connected to the third node;

an anode of the light emitting element is connected to the fourth node; and a cathode of the light emitting element is connected to the second power line.

11. A method for driving a display device, including a pixel circuit including a driving element for driving a light emitting element, a branch point, at which a second effective channel branches from a first effective channel, being located in the driving element, the method comprising:

applying a data voltage to a gate of the driving element in a data sampling phase; and supplying an electric current to the light emitting element during a light emitting phase, wherein the electric current flows in the first effective channel of the driving element in the data sampling phase, wherein the electric current flows in the second effective channel of the driving element in the light emitting phase, and a length of the second effective channel is shorter than a length of the first effective channel.

12. A display device, comprising:

a pixel circuit including a transistor for driving a light emitting element, the transistor including:

a first active pattern that is bent at least once in a channel region of the transistor; and a second active pattern branching from the first active pattern in the channel region of the transistor, the second active pattern having a shorter length than the first active pattern, wherein a branch point, at which the second active pattern branches from the first active pattern, is located in the transistor.

13. The display device according to claim 12, wherein:

the second active pattern includes a horizontal line portion passing through a first point on a left or right side of the channel region;

the first active pattern passes through a second point on an upper side and a third point on a lower side of the channel region; and the first active pattern is bent at least once between the second point and the third point.

14. The display device according to claim 13, wherein the horizontal line portion of the second active pattern branches from a vertical line portion of the first active pattern in a horizontal direction.

15. The display device according to claim 1, wherein the first and second active patterns of the channel region of the driving element include at least three ingresses or egresses.

* * * * *